US012768134B2

(12) United States Patent
Graber et al.

(10) Patent No.: US 12,768,134 B2
(45) Date of Patent: Oct. 20, 2026

(54) MATERIAL COLLECTION CONTAINER OF A SUCTION DREDGER WITH IMPROVED RESISTANCE TO NEGATIVE PRESSURE

(71) Applicant: RSP GMBH & CO. KG, Saalfeld (DE)

(72) Inventors: Anne Graber, Saalfeld (DE); Patrick Renger, Saalfeld (DE); Stefan Müller, Leutenberg (DE)

(73) Assignee: RSP GMBH & CO. KG, Saalfeld (DE)

( * ) Notice: Subject to any disclaimer, the term of this patent is extended or adjusted under 35 U.S.C. 154(b) by 288 days.

(21) Appl. No.: 18/703,931

(22) PCT Filed: Oct. 13, 2022

(86) PCT No.: PCT/EP2022/078573

§ 371 (c)(1),
(2) Date: Apr. 23, 2024

(87) PCT Pub. No.: WO2023/072617

PCT Pub. Date: May 4, 2023

(65) Prior Publication Data

US 2024/0426076 A1 Dec. 26, 2024

(30) Foreign Application Priority Data

Oct. 27, 2021 (DE) ..... 10 2021 128 037.0
Oct. 27, 2021 (DE) ..... 10 2021 128 038.9

(51) Int. Cl.

| | |
|---|---|
| ***E02F 3/88*** | (2006.01) |
| ***E02F 3/90*** | (2006.01) |
| ***E02F 9/08*** | (2006.01) |

(52) U.S. Cl.
CPC ..... *E02F 3/90* (2013.01); *E02F 3/8816* (2013.01); *E02F 9/0883* (2013.01); *E02F 9/0891* (2013.01)

(58) Field of Classification Search
CPC ..... E02F 3/8816; E02F 3/90; E02F 9/0883; E02F 9/0891
See application file for complete search history.

(56) References Cited

U.S. PATENT DOCUMENTS

| | | | | |
|---|---|---|---|---|
| 2019/0111825 | A1 | 4/2019 | Renger et al. | |
| 2019/0127950 | A1 | 5/2019 | Renger et al. | |
| 2020/0123736 | A1 * | 4/2020 | Renger | E02F 3/8816 |

FOREIGN PATENT DOCUMENTS

| | | | |
|---|---|---|---|
| CN | 202243117 U | * | 5/2012 |
| DE | 3837670 A1 | | 5/1990 |

(Continued)

*Primary Examiner* — Matthew R Buck
(74) *Attorney, Agent, or Firm* — Kaplan Breyer Schwarz LLP

(57) ABSTRACT

A material collection container extends in the longitudinal direction of a suction excavator and comprises a container wall which is closed at its two end faces by end walls. A lid is pivotably mounted on a lid shaft so that the material collection container is closed on the upper side and is open in an emptying position. The container has a seal extending between an upper edge and the lid in the closed position so that, in the closed position, the seal seals the container so that negative pressure can be generated in the container. The container wall has a plurality of side segment faces which extend in the longitudinal direction and transition into one another at stiffening edges. The folded upper edge is designed as a hollow profile. The seal is embedded in a groove on the side of the lid directed toward the upper edge.

14 Claims, 4 Drawing Sheets

(56) References Cited

FOREIGN PATENT DOCUMENTS

| | | | |
|---|---|---|---|
| DE | 102017108731 | A1 | 10/2018 |
| DE | 102016105850 | B4 | 2/2021 |
| EP | 0749870 | A1 | 12/1996 |
| EP | 3436306 | B1 | 10/2020 |

* cited by examiner

MATERIAL COLLECTION CONTAINER OF A SUCTION DREDGER WITH IMPROVED RESISTANCE TO NEGATIVE PRESSURE

BACKGROUND OF THE INVENTION

The present invention relates to a material collection container of a suction excavator. The material collection container has a container wall extending in the longitudinal direction, a pivotable lid, and a seal between the upper edge of the material collection container and the lid. The invention also relates to a suction excavator with such a material collection container.

A special application in the field of mobile working machines is the so-called suction excavator, which is generally equipped with a material collection container for receiving sucked-up material.

From DE 3837 670 A1, a suction excavator of this kind is known, comprising a pneumatic suction nozzle, a collection container for the sucked-up soil or comparable material, into which the suction nozzle opens and in which the sucked-up material is deposited from the suction air flow, and a suction blower connected to the collection container for generating the suction air flow. Further customary components of the suction excavator include guide elements for the suction nozzle, and filters for cleaning the suction air before it leaves the collection container again and is released into the environment. In the design of the suction excavator described in this document, a collection container is used which can alternatively be tilted about one of two tilt axes extending in the vehicle longitudinal direction toward the corresponding vehicle side in order to discharge the material deposited in the collection container.

EP 3436 306 B1 describes a vehicle, in particular a suction excavator with a vehicle frame, a tiltable material collection container which is suspended in a tilt axis extending parallel to the longitudinal axis of the vehicle, with a telescopic device and at least one rotary drive arranged at the container-side end of at least one telescopic arm in order to allow a rotation of the material collection container about the tilt axis.

DE 102016 105 850 B4 shows a material collection container of a suction excavator, wherein the material collection container can be closed by means of an at least two-part lid. The material collection container has a flat upper edge on which the lid rests in a working position in order to close the container tightly, so that a negative pressure can be generated therein.

EP 0749 870 A1 relates to a commercial vehicle in the form of a dump truck which can be emptied to the rear. The dump truck comprises a container formed by a self-supporting wall consisting of simple steel sheets. The wall is U-shaped and formed by segments which are at an angle to one another.

CN 202243117 U shows a truck comprising a dump body and an upper lid. The dump body is open at the top. The upper lid is arranged on the upper side of the dump body and closes the opening. The dump body consists of a floor panel and a dump body wall extending upwards around the floor panel. The upper lid consists of a lid plate and side walls which extend downwards around the upper plate. The upper lid is fastened to the dump body so that the side walls are positioned on the outside of the dump body wall. A seal arranged on the upper lid serves to prevent gases from escaping from the dump body.

DE 102017 108731 B4 discloses a suction excavator with a pivotable filter unit having a tiltable material collection container and a lid closing the same in a working position. This material collection container also has a flat upper edge.

General material containers of construction vehicles can be subdivided into two basic designs. While round containers are often used for transporting liquids and gases, tilting containers with an angular cross section are usually used in construction vehicles for transporting ground material and the like. Round containers, such as those of a tank vehicle, are quite complicated in production, since they have to be constructed as uniformly as possible in order to withstand the prevailing overpressure. However, they provide an optimal loading volume and a high pressure resistance with comparatively low weight. A further disadvantage is that the emptying of the round container mostly takes place via a small opening in the rear, which causes longer loading and unloading times. In contrast, the loading and emptying of a tilting container is much faster and easier through a large opening. However, the tilting container also has a high manufacturing effort, since, due to the many necessary reinforcements on the largely flat container wall, many weld seams are required for a desired high rigidity. This results in a higher dead weight, many contact surfaces for corrosion and breaking points or leaks at the weld seams.

Since the suction excavator uses negative pressure to suck up material, it is of particular importance that the negative pressure generated by a blower unit is communicated to a suction nozzle as loss-free as possible in order to pick up material. However, the known suction excavators which have a material collection container to be closed by a lid have considerable disadvantages. The negative pressure necessary for the suction process can only be produced with the fan units used if the collection chamber is tightly closed and does not draw any auxiliary air. The sealing effect between the lid and the collection chamber can already be massively impaired by structural tolerances resulting from production. In order to ensure the sealing effect, a seal is therefore used in the contact region between the lid and the suction chamber. But even in this case, the problem remains that, particularly during the emptying process, parts of the material emptied from the collection chamber often remain on the flat upper edge of the collection chamber or the seal, which parts can then considerably impair the sealing effect when the lid is closed and/or damage the seal. The suction material remaining in the sealing region must therefore be manually removed before the lid is closed. This is labor-intensive and sometimes endangers the operating personnel, since the regions to be cleaned are difficult to reach. In addition, the most often used sealing cords, which are round in cross section, move out of their retainer due to horizontal movements, for example during travel, or due to frequent opening movements of the lid. This in turn leads to leaks or to damage to the seal.

Proceeding from the prior art, the object of the present invention is therefore to provide an improved material collection container of a suction excavator which ensures high rigidity, with low material and manufacturing costs, and at the same time improved leakproofness under negative pressure in order to provide the required suction negative pressure with low energy consumption.

SUMMARY OF THE INVENTION

This object is achieved by a material collection container according to the appended claim 1 and/or by a suction excavator with such a container according to claim 12.

The material collection container according to the invention is designed for use as a component of a suction excavator. The material collection container extends in the longitudinal direction of the suction excavator and comprises a container wall extending in this direction. The longitudinal direction corresponds to the direction of travel of the suction excavator. The container wall is closed at its two end faces by a front and a rear end wall, respectively, so that a trough-shaped container interior is formed. A lid of the material collection container is pivotably mounted on a lid shaft. The lid closes the material collection container in a closed position at its upper side and opens it in an emptying position in order to be able to empty the material collection container, i.e., to be able to remove the sucked-up material. For this purpose, it is initially immaterial whether the material collection container is emptied by pivoting and tilting or for example by means of a gripper. Furthermore, the material collection container has a seal which is arranged between its upper edge and the lid so that the material collection container is sealed in the closed position of the lid in order to be able to build up the negative pressure in the material collection container required for the suction operation. In the closed position, the material collection container is thus sealed gas-tight, for which the container wall and the end walls must also be tightly connected to each other, at least in the negative pressure range required for the operation of the suction excavator.

The material collection container substantially has a U-shaped or trough-shaped cross section, wherein the bottom surface, the side surfaces and the end faces are designed to be gas-tight and the upper side of the container can be closed in a gas-tight manner by the pivotable lid.

The container wall has a plurality of side segment faces which transition into one another at stiffening edges. The stiffening edges extend in the longitudinal direction of the material collection container, preferably parallel to the vehicle longitudinal axis. Particularly preferably, a plurality of or all of such stiffening edges extend parallel to one another. Furthermore, at least some, preferably most of the side segment faces are arranged at an angle to one another so that the U-shaped cross section of the material collection container is formed in this way. The container wall has an upper edge which is designed as a hollow profile by means of a bent portion of the container wall, which hollow profile is in any case closed, preferably fully closed, at the upper side directed toward the lid. As a result, the upper edge has a smooth upper surface, in particular not disturbed by weld seams. An advantage of this embodiment is that the smooth surface counteracts wear when the suction material is dumped along the edge during emptying of the container. In addition, despite the strong turbulence in the suction container, undesired deposits or noise formations do not occur on weld seams.

The interaction of the selected U-shaped cross section, the hollow profile design of the upper edge and the segment-like structure of the container wall with the formed stiffening edges achieves a high degree of rigidity of the material collection container while simultaneously using less material, especially when using comparatively thin wall thicknesses. The material collection container can thus be dimensioned for an operating pressure, namely a negative pressure of up to −0.65 bar, without irreversible deformations occurring on the material collection container during operation of the suction excavator.

Preferably, a plurality of adjacent side segment faces are integrally formed, i.e. the stiffening edges extending between them are not produced by a joining process but by forming. Particularly preferably, adjacent segment surfaces inclined relative to one another are at their enclosed stiffening edge at an angle of >90° to <180°, preferably from 110° to 170°. According to a preferred embodiment, a plurality of segment surfaces are formed from a single sheet metal piece and are subdivided by formed stiffening edges.

It should be noted that, for manufacturing reasons, it is in many cases not possible to produce the entire container wall from a single piece. According to the invention, however, the aim is to keep the number of pieces to be connected to one another by joining processes (e.g., welding or folding) low and instead to produce them with a large surface area. The stiffening edges are then formed as crimps or with a similar design, so that the surface stiffness increases, but at the same time joints susceptible to leakage are avoided. Of course, individual portions of the material collection container can also additionally be equipped with reinforcing elements, e.g., ribs.

The width of side segment faces that are not additionally reinforced is preferably not greater than 150 times, particularly preferably not greater than 100 times, their corresponding material thickness or thickness. Dimensioning and determining optimized geometric ratios of a side segment face preferably takes place using suitable model calculations, for example, with the aid of the finite element method (FEM). Taking into account the geometric ratios, the distribution of the bearing forces, determination of the line loads, and maximum bending moments and the resulting bending stresses resulting, a suitable dimensioning formula can be determined, so that the yield strength $R_e$ of the material can be determined. A formula is specified below, which is particularly suitable for determining $R_e$:

$$R_e = \sqrt{\frac{9 * p^2}{256 * (1+x)^2 * t^4} * \left(b^4 x^2 + l^4 - x b^2 l^2\right)}$$

wherein:

$R_e$=yield strength of the material p=rated negative pressure in N/mm$^2$ x=ratio of segment length l to segment width b t=sheet thickness b=segment width l=segment length Using this dimensioning formula, the optimal segment width of the side segment faces and the position of the stiffening edges in the container wall can be approximately determined, so that the greatest possible volume for receiving suction material is achieved with a simultaneously high inherent stiffness of the material collection container. The container wall of the material collection container, formed from the side segment faces determined with the aforementioned dimensioning formula, should be simulated and checked for their load-bearing capacity with the finite element method (FEM).

According to a modified embodiment, at least one additional reinforcing element is arranged on the side segment faces, which preferably have a width greater than 150 times its material thickness. This can be designed, for example, in the form of a cross beam or a profile, preferably on the outside of the segment surface, so that the rigidity of the segment surface is increased and deformations are prevented.

The material collection container preferably has one or more floor segment surfaces which are formed on the underside as the bottom of the material collection container. The floor segment surfaces also preferably transition into one another at stiffening edges. In this region, however, additional rigidity can also be created through complementary reinforcing elements which are preferably arranged on the outside of the floor segment surfaces. This can be used primarily in the region of the standing surfaces or other force application points.

In a preferred embodiment, the material collection container has a particularly reinforced side segment face which is arranged on that side of the material collection container via which it can be tilted for emptying.

This stiffened side segment face has additional reinforcing elements, preferably on the outer side. An increased rigidity is thereby also ensured, so that no deformation or damage to the container wall is to be feared even during emptying. Due to the design of the stiffened side segment face that is nevertheless largely flat and obstacle-free on the inside, the suction material can slide along this surface more easily and without residues in the emptying position of the material collection container.

The seal, which extends between the upper edge and the lid for sealing, is embedded in a groove which extends on the underside of the lid directed toward the material collection container and which extends parallel to the upper edge of the material collection container in the closed position of the lid. It should be noted that in modified embodiments the seal can also be fastened in another suitable manner, provided that the gas-tightness between the upper edge and the lid is still ensured.

The seal preferably has a rectangular cross section which is selected to match the width of the groove, so that the seal sits tightly in the groove and does not jump out of the groove even when vibrations or movements occur. The upper edge to be sealed extends at least along the side walls of a collection chamber of the material collection container, preferably along the side walls of the entire material collection container, if said material collection container is to be sealed in its entirety by the lid. In its course, the upper edge is preferably formed by two edge surfaces which converge at an angle, so that the edge surfaces of the upper edge enclose an angle $\alpha$ and form an abutting line which extends in the sealing plane. The upper edge has a width at the abutting line of the converging edge surfaces which is preferably smaller than the width of the groove so that the upper edge enters or is pushed into the seal in the closed position. A sealing line is thereby formed along which the seal encloses the upper edge on both sides. This leads to a consistently high sealing effect, even if tolerances in the progression of the upper edge or possibly smaller damages occur. In addition, a substantial advantage of this preferred design of the upper edge is that no horizontal surface remains on it, on which material residues can deposit when the lid is open. In particular, even during emptying of the material collection container, all parts of the sucked-in material immediately fall away from the upper edge, so that they are no longer jammed between the seal and the upper edge when the lid is closed. The design of the upper edge by means of the two edge surfaces which are inclined relative to one another and which are preferably integrally formed at the abutting edge and which transition into one another without irregularities, also leads, due to the profile-induced stiffness, to a high inherent stability of the upper edge and at the same time to the protection of the seal, since a sharp edge, which may possibly damage the seal, is avoided. Particularly preferably, the seal has a closed surface or at least with low porosity, so that particles of the suction material cannot settle in pores and thus wear the seal. On the one hand, this guarantees easier cleaning and longevity of the seal.

The described combination of a material collection container formed according to the invention with the seal, which, according to the invention, is attached to its lid and which interacts with a correspondingly designed upper edge, leads to a sturdy, comparatively light and yet gas-tight material collection container. The U-shaped cross section stiffens the material collection container such that twisting or deformation of the upper edge is reliably avoided, even at the required negative pressure in the container. This is an important prerequisite for a permanently sealed closure by the lid carrying the seal. At the same time, the upper edge, which is preferably trapezoidal in cross section, prevents dirt particles or other deposits from adhering there and thus possibly impairing the sealing effect. Due to the combined application of these features, it is possible to generate a comparatively stable negative pressure in the material collection container with a fan or blower of the suction excavator and to minimize the pressure losses that otherwise occur due to leaks in the container. The dynamic negative pressure required on the suction nozzle of the suction excavator can therefore be produced with less energy consumption.

The seal is preferably soft-sealing, so that movements are better absorbed and structural tolerances resulting from the production of the material collection container are better compensated. Due to the soft-sealing material of the seal, the upper edge of the collection chamber can preferably be pressed about 3-15 mm into the seal. A better sealing effect is thereby established, as the seal adapts to the rounding of the upper edge. This means that quite significant construction tolerances can be compensated for over a larger area. The negative pressure of up to −0.65 bar, which is usually generated in the case of suction excavators, can therefore be maintained with less energy consumption. With increasing negative pressure during the working process of the suction excavator, the lid, including the seal, is sucked in more strongly. Since the seal is located in a form-fitting manner within the groove in the lid, the seal can only move in the direction of the upper edge and thus seals the material collection container more tightly.

The upper edge of the material collection container is preferably designed to be triangular or trapezoidal in cross section, in particular, in the manner of a hollow profile. Preferably, the angle $\alpha$ formed by the two edge surfaces of the upper edge is approximately 20° to 120°, particularly preferably between 45° and 90°. This angular range leads to a high rigidity of the profile, so that deformation of the upper edge is counteracted by the negative pressure in the collection chamber and by the press-on pressure of the lid. As a result, the service life of the seal of the material collection container is extended. Furthermore, the edge surfaces of the upper edge inclined in this way have the advantage that no or hardly any suction material can settle on the edge surfaces. The smaller the enclosed angle, the greater the self-cleaning effect that occurs at the edge surfaces. This also eliminates the manual cleaning process known from the state of the art, which in turn ensures smooth operation of the suction excavator. Furthermore, the inner, inclined edge surface deflects the suction flow in the collection chamber in such a way that the suction material in the suction flow wears the inner edge surface and the seal inside the groove less.

The upper edge preferably has an outer radius in the range of 8-65 mm, particularly preferably 10-25 mm, at the abutting line of the edge surfaces. The result of this is that the upper edge has a smooth surface which is at the same time sufficiently wide for the sealing effect. An advantage of this embodiment is that the seal is protected in the closed position, since the force which arises when the lid is placed onto the upper edge acts on a rounded surface. On the other hand, the smooth surface counteracts wear in the emptying position when the suction material is dumped along the edge.

The invention further relates to a suction excavator having a material collection container according to one of the embodiments described above. The material collection container is preferably fastened to the vehicle so that it can be emptied in the direction of a longitudinal side of the vehicle. In particular, the material collection container can be titled to both sides of the vehicle.

At the same time, it is expedient if a raised position of the tilt axis is provided in order to allow the material collection container to be emptied to surfaces of different heights, for example, an adjacent vehicle. The tilt axis preferably extends in a plane of symmetry of the material collection container, which particularly preferably encloses a longitudinal axis of the vehicle in a resting, working or transport state.

In addition to the above-mentioned features, the material collection container preferably has further components. The material collection container preferably comprises a suction connection at its rear end wall and a suction flow guide which leads from the suction connection through the already mentioned collection chamber to a filter unit and downstream thereof via a fan to an exhaust air outlet. Furthermore, the material collection container preferably comprises a pivot bearing on each of its two end walls, which pivot bearing allows a suspension of the material collection container in the tilt axis.

Due to its design with stiffening edges, the material collection container has considerable advantages over the previously known container shapes used in suction excavators so far. Due to the still implementable large opening of the material collection container, which can be closed by a lid, rapid removal of the suction material located therein is possible. Furthermore, due to the stiffening edges in the container wall, separate reinforcements can be dispensed with or their number can be reduced in any case, so that a low weight can be achieved with a high rigidity of the material collection container. Finally, a larger volume for collecting material is available than in conventional material collection containers. By combining the container wall provided with stiffening edges and the upper edge formed as a hollow profile, a very rigid edge is achieved and at the same time an optimized contact surface is provided for the seal in the lid.

BRIEF DESCRIPTION OF THE DRAWINGS

Further details, advantages and developments of the present invention are apparent from the following description of a preferred embodiment, with reference to the drawing. Shown are.

DETAILED DESCRIPTION OF THE INVENTION

Figure 1:
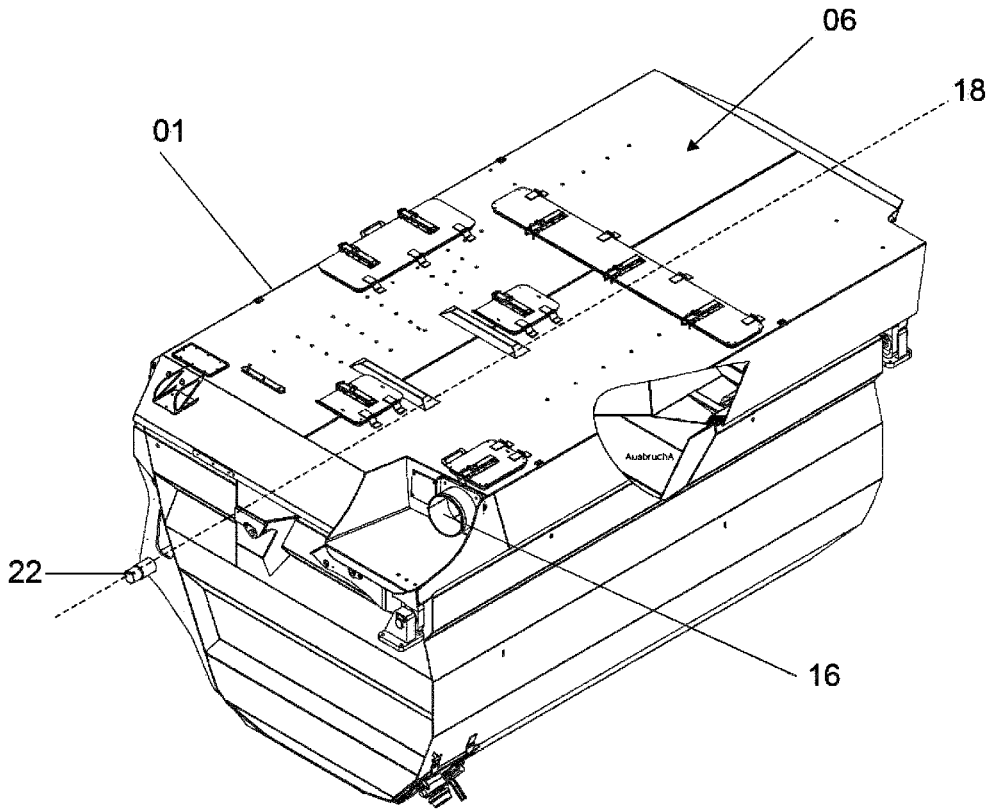
FIG. 1 is a first overall view of a material collection container according to the invention.

FIG. 1 is a first perspective overall view of a material collection container 01 according to the invention. In the embodiment shown, the material collection container is closed and has a lid 06 which is designed in this case as one piece. Embodiments with multipart lids are also possible. The material collection container has at least one collection chamber 23 (FIG. 6) into which material to be received is sucked. Furthermore, a tilt axis 18 extends longitudinally through the material collection container, in which tilt axis the material collection container 01 can be suspended on the chassis of a suction excavator (not shown). Furthermore, the material collection container 01 comprises a suction connection 16 on an end wall. A pivot bearing 22 is also arranged on each of the end walls, wherein the tilt axis 18 extends through these pivot bearings 22.

Figure 2:
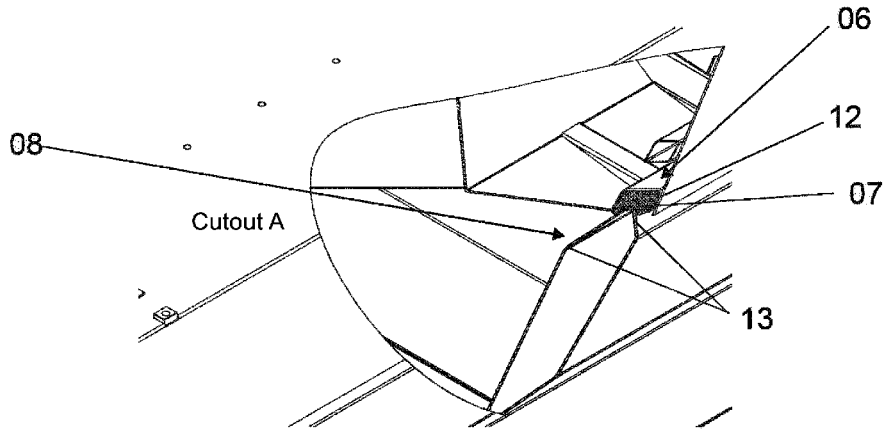
FIG. 2 shows a detail from the view of the material collection container according to FIG. 1.

FIG. 2 is a detailed view of the material collection container (cutout A), the details of which are explained below in connection with FIG. 6.

Figure 3:
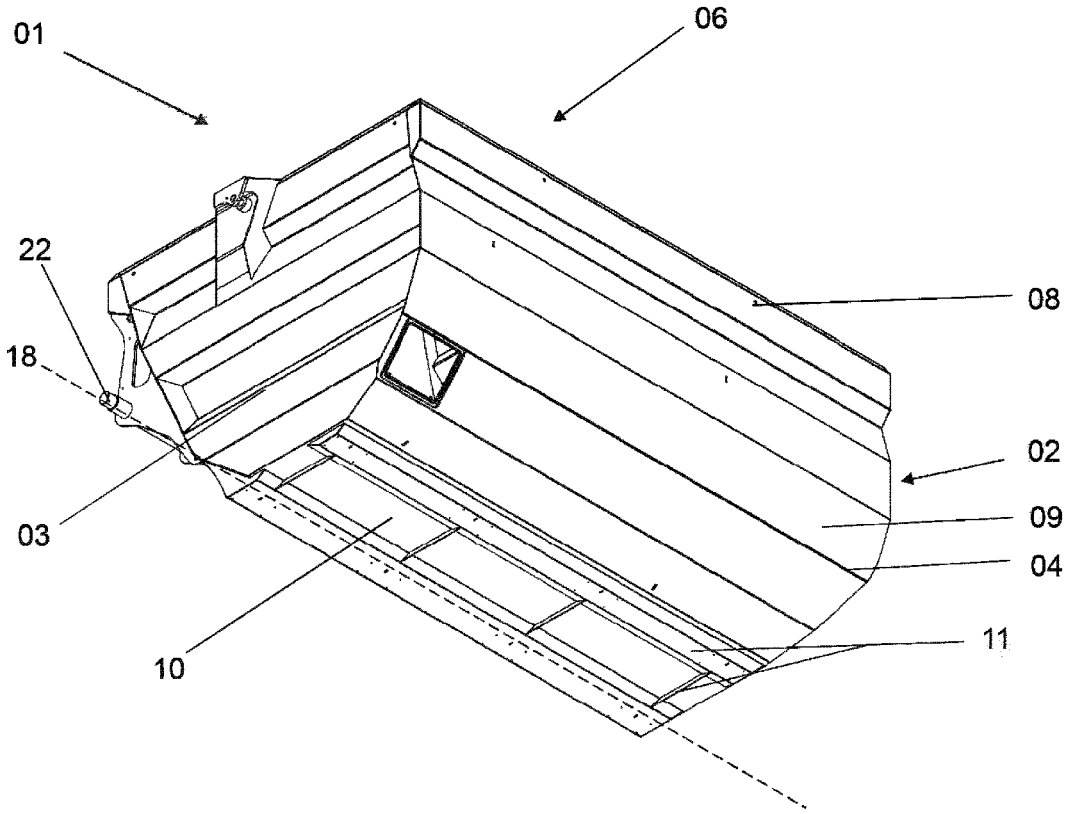
FIG. 3 is a second perspective overall view of the material collection container.

FIG. 3 is a second perspective overall view of the material collection container 01. In the embodiment shown, the material collection container 01 is closed. In the longitudinal direction of the chassis (not shown) of the suction excavator, the tilt axis 18 extends longitudinally through the material collection container, about which tilt axis the material collection container 01 can be tilted for emptying when the lid is open.

The material collection container 01 has a container wall 02 comprising a plurality of side segment faces 09 which each transition into the stiffening edges 04. The stiffening edges 04 extend parallel to the longitudinal direction of the material collection container. In this embodiment, the container wall 02 comprises eight segment surfaces 09 on each side and additionally a floor segment surface 10. The adjacent side segment faces 09 are oriented at an angle to one another, wherein the container wall bends inward at each stiffening edge, in the upper region of the container wall by approximately 10°-20° and at the transition to the floor segment surface by approximately 90°. In other words, directly adjacent side segment faces include an angle in the range of ≥90° to <180°. Using the above-mentioned FEM calculation, the stiffening edges are positioned during the design process so that they increase the overall rigidity of the material collection container compared to a container wall without stiffening edges.

The side segment faces 09 preferably have a width not greater than 150 times their material thickness. If a material thickness of, for example, 4 mm is selected, the width of the side segment face is ≤40 cm.

For a further increase in the rigidity of the container wall, in the embodiment shown, a plurality of reinforcing elements 11 are arranged as cross members on the outside of the floor segment surface 10 and in the longitudinal direction, which can be designed as a hollow profile. Such reinforcing elements can, if required, also be attached to individual side segment faces and/or the end faces, preferably on the outside thereof.

In the embodiment shown in FIGS. 1 and 3, the end walls 03 also have segment surfaces and stiffening edges. The end walls are substantially perpendicular to the side segment faces 09 of the container wall 02. This increases the rigidity of the entire material collection container.

Figure 4:
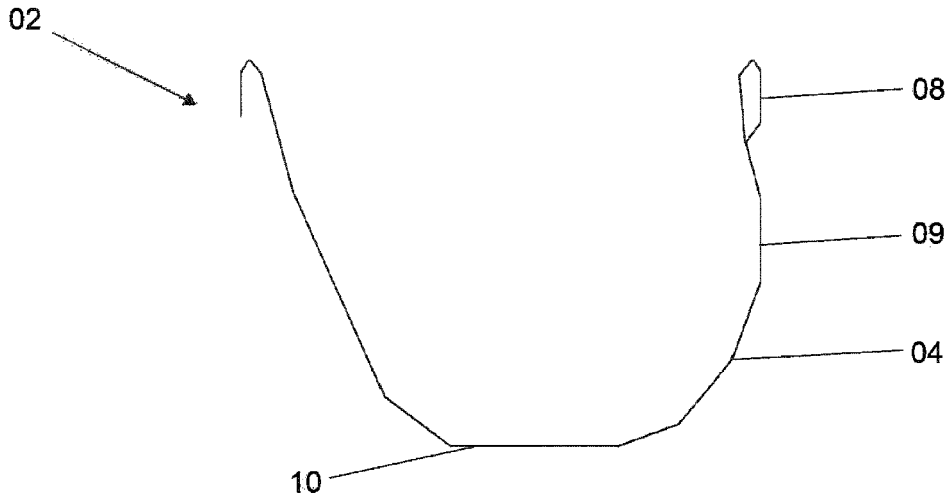
FIG. 4 shows a cross section of the container wall of the material collection container at an early stage of the dimensioning.

FIG. 4 is a sectional view of the container wall 02, including an upper edge 08 of the material collection container 01 in an early dimensioning phase. For example, by using FEM simulations (see above), the cross section of the container and the position of the stiffening edges can be gradually optimized until the desired compressive strength is reached.

The side segment face, which is arranged on the tilting side of the material collection container, should form a surface that is as large and straight as possible, so that the suction material can slide out of the container more easily and with less resistance in an emptying position.

The side segment faces 09 can be bent from a sheet metal piece at the stiffening edge 04 or have a multipart design so that they are connected to one another at the stiffening edges 04, preferably by welding. Depending on the dimensions and the manufacturing process, the stiffening edges are thus formed as folded edges/crimps in the material of the container wall or as welded or folded seams between the side segment faces.

Figure 5:
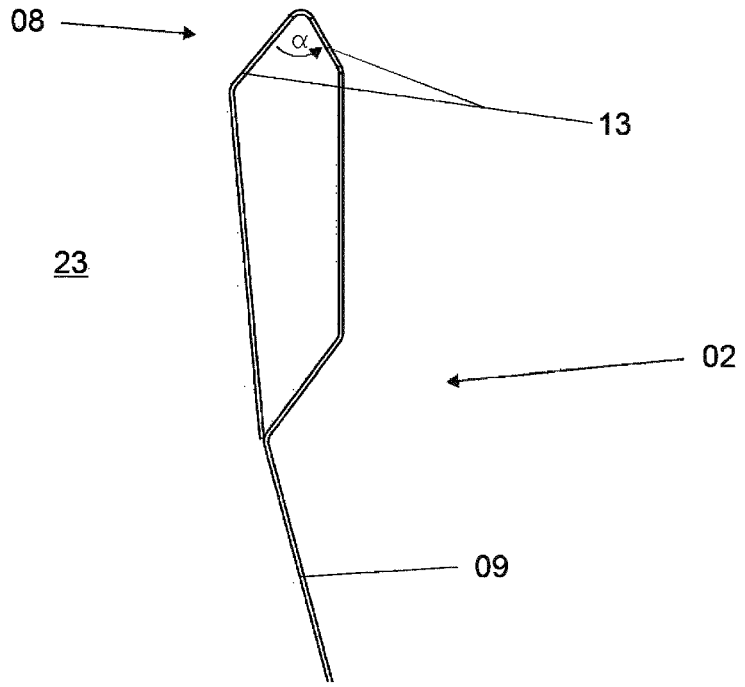
FIG. 5 is a simplified sectional view of the container wall in the region of its upper edge.

FIG. 5 is a sectional view of the material collection container 01 in the region of the upper edge 08. The upper edge 08 forms at least the upper edge of the collection chamber 23, but in modified embodiments may also comprise the upper edge of the entire material collection container 01. The upper edge 08 thus extends at the upper end of the side walls of at least the collection chamber 23. The upper edge 08 has two edge surfaces 13 which taper at an angle to one another and enclose an angle $\alpha$. This angle is preferably 20° to 160°, particularly preferably 45° to 90°, so that the edge surfaces 13 have a greater or lesser inclination relative to the horizontal. The two edge surfaces 13 are inclined toward one another at an angle and form a triangular or roof-shaped, preferably hollow, cross section. Alternatively, the cross section of the upper edge 08 can also be selected to be trapezoidal. For stability reasons, the edge is also preferably designed as a hollow profile.

Figure 6:
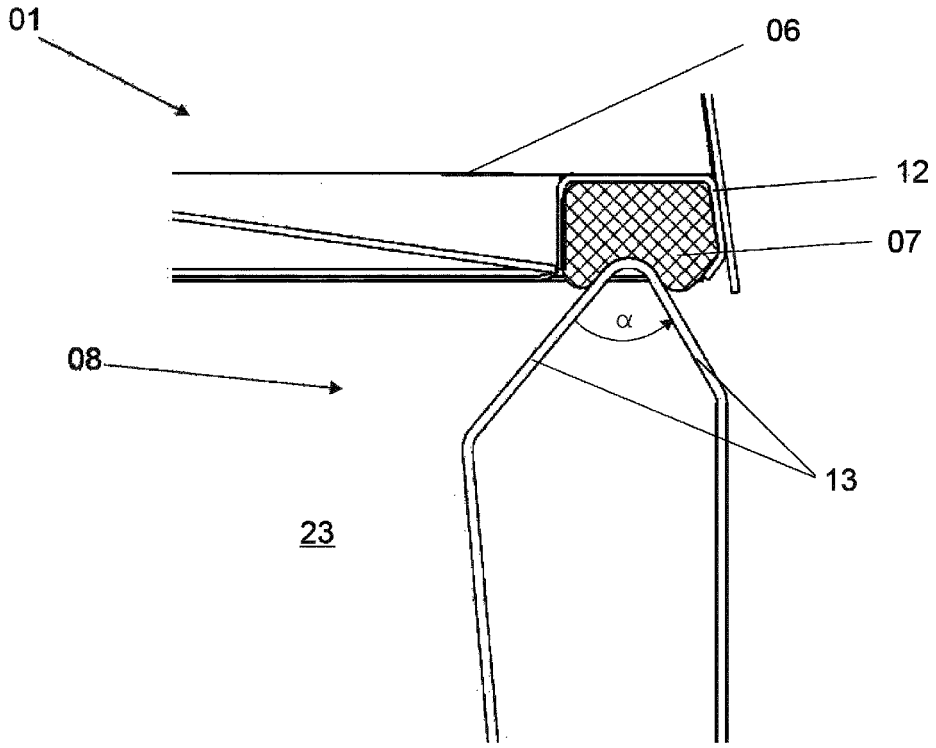
FIG. 6 is a simplified sectional view of the material collection container in the region of a seal.

FIG. 6 is a sectional view of the material collection container 01 in a closed position in which the lid 06 rests on the upper edge 08. The lid 06 is preferably designed as a substantially flat plate. Alternatively, the lid 06 can be designed in two or more parts or have elevations and/or depressions. A groove 12 extends on the underside of the lid 06, into which groove a seal 07 with a rectangular cross section is embedded in a form-fitting manner. The groove 12 can additionally have a continuous or sectionally narrowing on its open side in order to prevent the seal 07 from falling out. The upper edge 08 extends below the groove 12 and enters the seal 07 in the closed position.

In the closed position, the position of the lid 06 is selected such that the upper edge 08 presses into the seal 07, for example, about ¼ to ½ of the thickness of the seal 07.

Figure 7:
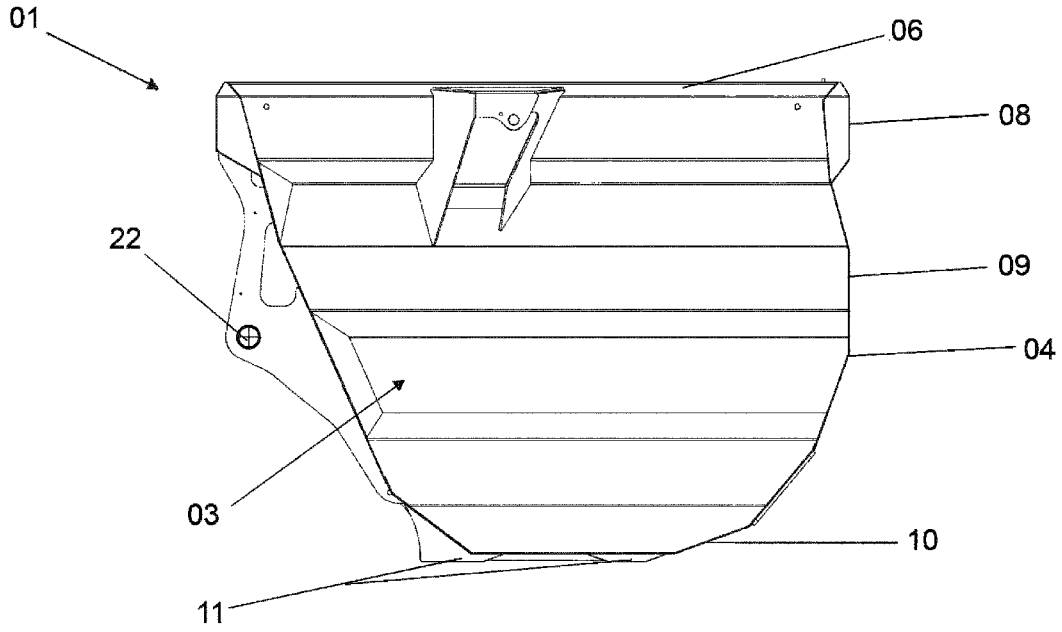
FIG. 7 is a side view of the material collection container.

FIG. 7 is a side view of the material collection container 01, wherein the lid 06 is in its closed position. The lid 06 closes the material collection container 01 in such a way that the upper edge 08 presses into the seal 07 (FIG. 6). The one or more side segment faces 09, which are arranged on the tilting side of the material collection container 01, form a surface which is large in comparison to the opposite side segment faces and which is free of obstacles on its inside, so that the suction material can slide out of the container easily and with low resistance in the emptying position, i.e., when the material collection container is tilted. On the outside of said large side segment face 09, a plurality of reinforcing elements 11 extending transversely to the longitudinal extension of the segment surface are arranged, which support the side segment face at a plurality of points. Said reinforcing elements 11 can simultaneously form the mount for the tilt axis 18 and for the pivot bearings 22 positioned at the end face.

Further reinforcing elements 11 are arranged on the outside of the floor segment surface 10, which elements are shaped as transverse and longitudinal ribs, wherein the reinforcing elements 11 extending in the longitudinal direction are preferably designed as a hollow profile.

In the embodiment shown, the material collection container 01 has, for example, a height of approximately 1.8 m (when the lid is closed) and a width of approximately 1.9 m to 2.4 m (at the widest point). The length of the container is in the range of 3.5 m to 4 m. Of course, other dimensions are possible, adapted to the suction excavator to be equipped.

FIG. 8 is again an overall view of the material collection container, approximately from the same perspective as FIG. 1. In the view shown here, the material collection container 01 is open, wherein the lid is not shown for the sake of simplicity. The container wall 02 is composed on each longitudinal side of eight side segment faces 09 and on the underside of the floor segment surface 10. In this embodiment, the adjacent side segment faces 09 each enclose an angle in the range of ≥70° to <180°. The container wall preferably has a material thickness of 4 mm, the width of the individual side segment faces 09 is approximately 35 cm on the side facing away from the tilt axis 18 between successive stiffening edges.

Figure 8:
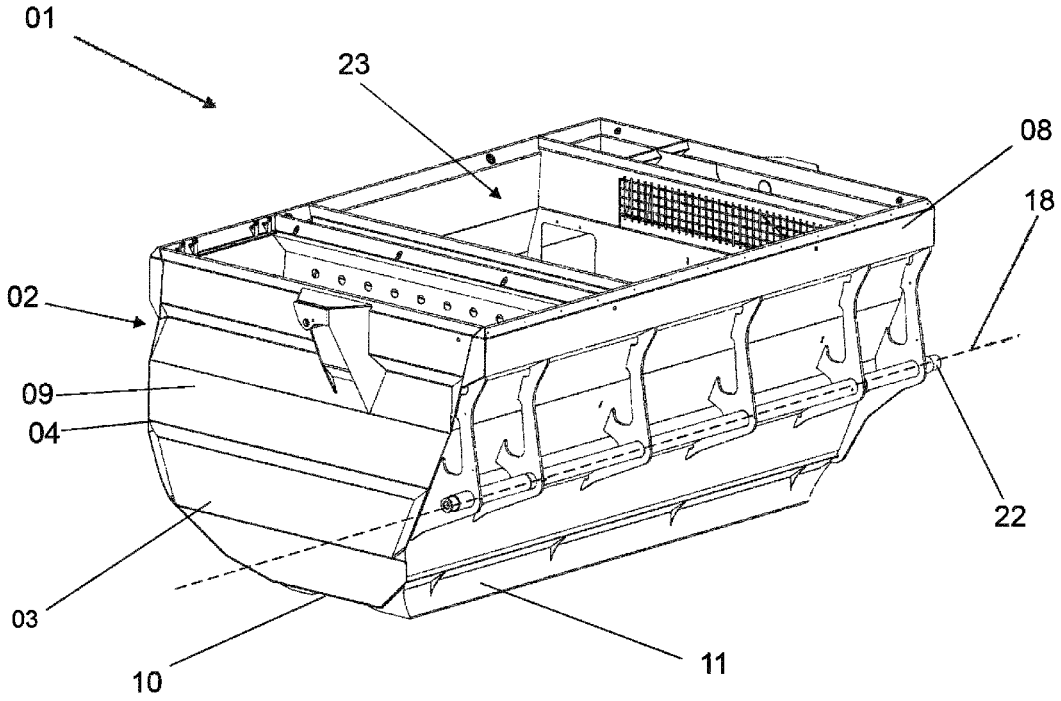
FIG. 8 is a perspective overall view of the material collection container.

In the embodiment shown in FIG. 8, the end walls 03 also have side segment faces 09 and stiffening edges. The end walls 03 are substantially perpendicular to the side segment faces 09 of the container wall 02. As already described above, this increases the rigidity of the entire material collection container. The material thickness and the width of the segments installed on the end faces correspond to those at the side of the container facing away from the tilt axis.

It can furthermore be seen from FIG. 8 that further chambers are provided in the material collection container next to the collection chamber 23, in which chambers, for example, filter units and the fan unit are accommodated.

The invention claimed is:

1. A material collection container of a suction excavator, wherein the material collection container extends in a longitudinal direction of the suction excavator and has a rigidity which withstands a negative pressure corresponding to an operating negative pressure of the suction excavator, comprising:

a container wall extending in the longitudinal direction and which is connected at its two end faces to end walls;

a pivotable lid which, in a closed position, closes the material collection container on its upper side and opens the pivotable lid in an emptying position;

a seal extending in the closed position between an upper edge extending along the container wall and the end walls of the material collection container and the lid in order to seal the material collection container so that a negative pressure can be generated in the material collection container;

wherein the material collection container has a substantially U-shaped cross-section;

the container wall has a plurality of side segment faces extending in the longitudinal direction and merging into one another at stiffening edges, wherein at least some adjacent side segment faces are at an angle to one another;

the upper edge of the container wall is a folded upper edge which has a hollow profile;

the seal is embedded in a groove on a side of the lid directed toward the upper edge;

the folded upper edge is formed by two edge surfaces which converge at an angle, wherein a width of the upper edge at a joint line of the converging edge surfaces is narrower than a width of the groove, wherein the folded upper edge enters the seal in the closed position of the lid.

2. The material collection container according to claim 1, wherein at least a plurality of adjacent side segment faces, including the stiffening edges extending between them, are integrally formed.

3. The material collection container according to claim 1, wherein the width of side segment faces which are not additionally reinforced is not greater than 150 times their material thickness.

4. The material collection container according to claim 1, wherein the material collection container has one or more floor segment surfaces (10).

5. The material collection container according to claim 1, wherein at least one additional reinforcing element is arranged on the outside of at least one of the side segment faces (09).

6. The material collection container according to claim 1, wherein at least one of the side segment faces, which is located on that side of the material collection container via which the material collection container can be tilted for emptying, has additional reinforcing elements.

7. The material collection container according to claim 1, wherein the two converging edge surfaces of the upper edge enclose an angle $\alpha$ of 20° to 90°.

8. The material collection container according to claim 1, wherein the upper edge has an outer radius in the range of from 8 to 65 mm on the abutting line of the converging edge surfaces.

9. The material collection container according to claim 1, wherein the folded upper edge of the container wall is triangular or trapezoidal in cross section.

10. The material collection container according to claim 1, wherein the folded upper edge is formed by a folded portion of the container wall.

11. The material collection container according to claim 1, wherein at least some of the side segment faces (09) are defined by the following formula:

$$R_e = \sqrt{\frac{9 * p^2}{256 * (1 + x)^2 * t^4} * \left(b^4 x^2 + l^4 - x b^2 l^2\right)}$$

wherein:

$R_e$=yield strength of the material

P=rated negative pressure in N/mm$^2$ x=ratio of segment length 1 to segment width b t=sheet thickness b=segment width l=segment length.

12. A suction excavator comprising:

a vehicle frame having a longitudinal direction;

a tiltable material collection container (01) which is suspended in a tilt axis (18) extending parallel to the longitudinal direction;

wherein the material collection container (01) is designed according to claim 1.

13. The suction excavator according to claim 12, wherein the material collection container furthermore has a suction connection on its rear end wall and a suction flow guide leading from the suction connection through a collection chamber to a filter unit, and in that the material collection container furthermore has a pivot bearing on its two end faces, which pivot bearing allows the material collection container to be suspended in the tilt axis.

14. The suction excavator according to claim 12, wherein the lid closes the entire material collection container on its upper side in the closed position, and in that, in the closed position, the seal extends between the upper edge of the material collection container and the lid in order to seal the entire material collection container so that a negative pressure can be generated in the material collection container.

* * * * *